US005123116A

United States Patent [19]

Roth

[11] Patent Number: 5,123,116

[45] Date of Patent: Jun. 23, 1992

[54] WRESTLING BLINDER

[76] Inventor: James M. Roth, P.O. Box 432, Topeka, Ind. 46571

[21] Appl. No.: 685,902

[22] Filed: Apr. 16, 1991

[51] Int. Cl.[5] ..... A63B 71/00

[52] U.S. Cl. ..... 2/15; 2/9; 2/171; 2/173; 2/206; 2/424; 2/425

[58] Field of Search ..... 2/2, 9, 15, 202, 203, 2/206, 207, 171, 173, 410, 425, 424, 199, 185 R

[56] References Cited

U.S. PATENT DOCUMENTS

| | | | |
|---|---|---|---|
| 869,741 | 10/1907 | Seitzman | 2/206 |
| 1,023,285 | 4/1912 | White | 2/9 |
| 1,449,183 | 3/1923 | Johnstone | 2/9 |
| 1,514,516 | 11/1924 | Golomb | 2/9 |
| 1,584,012 | 5/1926 | Cocroft | 2/206 |
| 1,716,550 | 6/1929 | Hart | 2/206 |
| 1,807,475 | 5/1931 | Gibson | 128/132 |
| 2,134,640 | 10/1938 | Merkin | 2/174 X |
| 2,418,376 | 4/1947 | Turner | 2/9 |
| 2,537,768 | 1/1951 | Laporte | 2/15 |
| 2,616,081 | 11/1952 | Weaver et al. | 2/9 |
| 3,271,781 | 9/1966 | Sontag et al. | 2/202 |
| 3,311,921 | 4/1967 | Helm | 2/425 X |
| 3,327,316 | 6/1967 | Pukishj, Jr. | 2/425 X |
| 3,513,482 | 5/1970 | Holden | 2/425 X |
| 3,541,608 | 11/1970 | Otwell | 2/15 |
| 3,596,288 | 8/1971 | Marchello | 2/425 X |
| 3,686,690 | 8/1972 | Webb | 2/9 |
| 3,780,379 | 12/1973 | Kampman | 2/15 |
| 4,502,476 | 5/1985 | Welt | 128/132 |
| 4,520,509 | 6/1985 | Ward | 2/DIG. 6 |
| 4,551,861 | 11/1985 | Marchello | 2/425 |
| 4,644,588 | 2/1987 | Zawacki | 2/10 |
| 4,656,668 | 4/1987 | Castrejon | 2/15 |
| 4,710,985 | 12/1987 | Dubner et al. | 2/425 |
| 4,847,921 | 7/1989 | Leutholt | 2/424 X |
| 4,912,777 | 4/1990 | Gasbarro | 2/425 X |
| 4,972,520 | 11/1990 | Grilliot et al. | 2/202 X |
| 5,067,174 | 11/1991 | Ritchey et al. | 2/171 X |

FOREIGN PATENT DOCUMENTS

| | | | |
|---|---|---|---|
| 127130 | 10/1927 | Switzerland | 2/206 |

*Primary Examiner*—Werner H. Schroeder
*Assistant Examiner*—Jeanette E. Chapman
*Attorney, Agent, or Firm*—Baker & Daniels

[57] ABSTRACT

The present invention is a blinder attachment for wrestling headgear. The attachment has an extension with VELCRO strips which allows it to wrap over the band or strap of the wrestling headgear to form a loop and secure the blinder over the eyes. Also, laces are provided that extend through holes in the blinder and headgear ear guards so that the blinder may be further secured on the head. The blinder includes eye pillows which gently press against the eye lids to urge the eyes shut and prevent most light from penetrating to the eyes. By parcticing with the wrestling blinder of the present invention, wrestlers may improve their kinesthetic awareness and thereby improve their wrestling performance.

20 Claims, 1 Drawing Sheet

WRESTLING BLINDER

BACKGROUND OF THE INVENTION

1. Field of the Invention.

The present invention relates to sporting equipment used to train wrestlers. More specifically, the field of the invention is that of blinder attachments for wrestling headgear.

2. Prior Art.

The sport of amateur wrestling is practiced extensively at primary schools, secondary schools, and universities all over the nation, in preparation for wrestling competitions. Wrestlers typically wear headgear during both wrestling practices and competitions. The headgear comprises protective ear guards which are held on the head by a halo or strap arrangement. The halo arrangement includes a band which is for locating around the top of the head with two integral ear guards extending from the band and over the ears, with a detachable chin strap connecting the ear guards around the chin. The strap arrangement includes two ear guards which are attached by straps around the top and sides of the head, for example with two pairs of straps attached between the two ear guards, and a detachable chin strap which connects the ear guards around the chin. In addition, both arrangements allow for the attachment of a face mask to the headgear.

One training method used for developing wrestling skill is blind wrestling, wherein one of the wrestlers is blinded so that the blinded wrestler acts and reacts having feeling as the only sensory input. Blind wrestling helps in training wrestlers to react to opponent's moves without needing visual information, and thereby avoiding the wrestler's instinctive tendency to turn the head and look before making a move. Blind wrestling provides a unique training method for improving a wrestler's kinesthetic awareness which many wrestlers and coaches believe substantially increases the effectiveness of training.

However, a problem encountered in blinded wrestling training is that of attaching the blinder to the wrestler. Wrestling involves movements of the body and head which may cause a conventional blinder to be partially or fully dislodged from over the eyes, thus eliminating the benefits of using the blinder. Also, the wrestling headgear interferes with the attachment of conventional blinders because of the headgear covering the ears and head. Further, conventional blinders are easily unseated by the bumping and jostling which occurs during wrestling.

Many conventional blinders, such as blindfolds or opaque glasses, may block only the direct view of the eyes but may allow light to enter near the peripheries of the eyes. Peripheral vision should be totally suppressed for obtaining the maximum benefit of blinded wrestling, because even visual stimuli from the periphery may distract the wrestler. Further, the bumping and jostling incident to wrestling may tend to unseat such conventional blinders and thereby limit their effectiveness.

What is needed is wrestling headgear having blinders for blind wrestling training.

Also needed is a blinder attachment for wrestling headgear which may be easily and securely attached to the headgear.

A further need is a blinder attachment adapted to attach to any standard wrestling headgear for any head size.

An additional need is a blinder attachment which better blocks peripheral vision.

SUMMARY OF THE INVENTION

The present invention is a blinder attachment for wrestling headgear. The blinder easily and securely attaches to the headgear with an extension having matching securing strips which loop over the head band or strap. Also, laces may be used to attach the blinder through holes in the ear guards.

The blinder may be used by a wide range of wrestlers because it may accommodate varying, head sizes by adjusting the connection of the securing strips of the extension and the laces. Further, the wrestler wearing the blinder attachment may have the blinder adjusted while on the wearer to get the best fit. The blinder is even compatible with face masks used with the wrestling headgear because the securing strips and laces do not interfere with the connection of the mask to the headgear.

The blinder is made of comfortable, absorbent, and durable material such as terry cloth, spandex, canvas, etc., so the blinder does not irritate the wearer. Also, the Velcro securing strips are located on only one side of the blinder extension, the side which is folded over so that the Velcro does not contact the wearer or the opponent. Once the blinder is properly adjusted, the headgear and blinder may be taken off and put back on the same wrestler without needed further adjustment. The eye pillows of the blinder sufficiently fill the wrestler's eye sockets so that the eyes are gently pressed shut by the pillow stuffing for urging the eyes shut and making only extremely downward vision possible, with little or no light penetrating to the peripheries of the eyes.

The blinder may be manufactured out of a single rectangular piece of material which is appropriately cut and has the Velcro strips attached. The eye pillows are formed by an oval piece of material being attached to the blinder at a reduced periphery with extra material of the rectangular piece being used as the pillow stuffing. The laces may be attached through holes at the sides of the blinder, which may be formed in a doubled over portion or formed by grommets. Thus the blinder may be readily manufactured from preexisting materials by use of a relatively uncomplicated pattern.

The present invention is, in one form, a blinder attachment for use with wrestling headgear so that the eyes of the wearer of the headgear are generally blocked. The blinder attachment comprises a body, an extension, and an attaching device. The body portion is adapted to cover the eyes. The extension has an end and a base, and is adapted to loop around a portion of the headgear so that the end may be positioned adjacent to the base. The attaching device interconnects the end and the base of the extension to form a loop with the extension so that the blinder attachment is secured to the headgear.

One object of the present invention is to provide wrestling headgear having a blinder for blind wrestling.

Also an object is providing a blinder attachment for wrestling headgear which may be easily and securely attached to the headgear.

A further object is providing a blinder attachment able to be attached to any standard wrestling headgear for any head size.

An additional object is providing a blinder attachment which better blocks peripheral vision.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates preferred embodiments of the invention, in one form, and such exemplifications are not to be construed as limiting the scope of the invention in any manner.

DESCRIPTION OF THE PREFERRED EMBODIMENT

Figure 1:
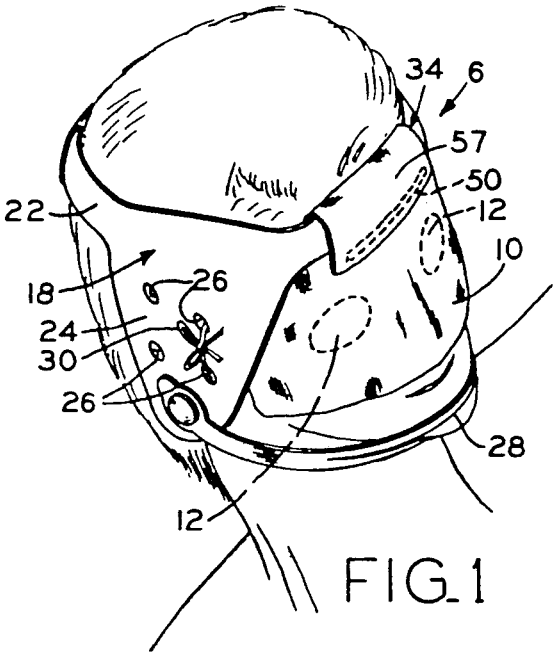
FIG. 1 is a perspective view of a wrestler with a halo headgear arrangement and a blinder attachment of the present invention.
Figure 2:
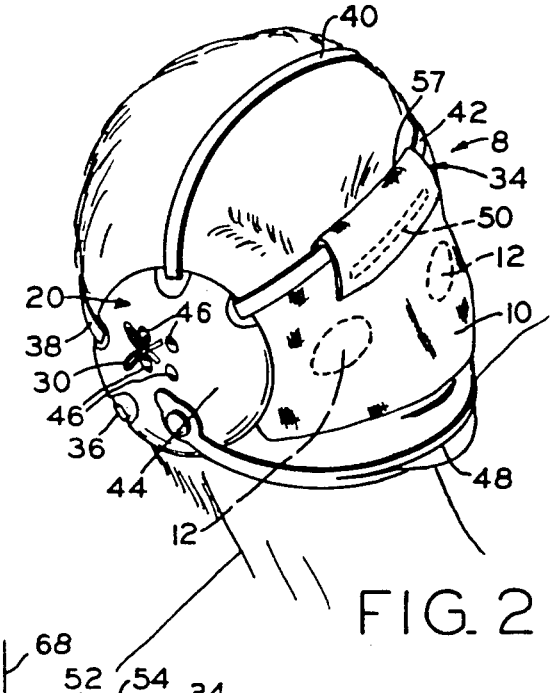
FIG. 2 is a perspective view of a wrestler with a strap headgear arrangement and a blinder attachment of the present invention.
Figure 4:
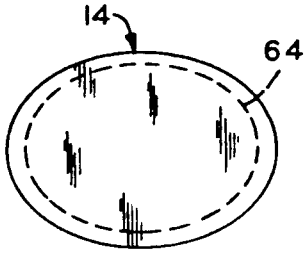
FIG. 4 is a top view of an eye pad.
Figure 5:
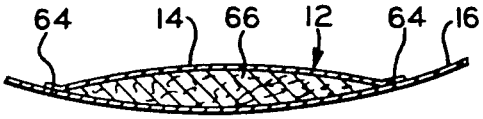
FIG. 5 is a sectional view taken along view lines 5—5 of FIG. 3.

The present invention relates to wrestling headgear, and specifically to halo headgear blinder arrangement 6 of FIG. 1, and strap headgear blinder arrangement 8 of FIG. 2. Each arrangement uses blinder attachment 10 shown in FIG. 3, which includes eye pillows 12 formed by eye pads 14 and blinder body 16 as shown in FIGS. 4 and 5. With either of arrangements 6 or 8, blind wrestling may be conventionally practiced by having one blinded wrestler wrestle a sighted wrestler. Although blinder 10 may be removed by conventionally detaching halo headgear 18 or strap headgear 20, the wrestler wearing blinder 10 has little, if any, vision because the eye lids are urged shut by eye pillows 12. The details of arrangements 6 and 8, as well as particular description of blinder attachment 10, is given below.

Halo headgear arrangement 6 comprises halo headgear 18 and blinder attachment 10. Halo headgear 18 has a conventional design which includes a top band or portion 22 with two integrally formed ear guards 24. Ear guards 24 have four holes 26 and are removably attached at their lower portions by chin strap 28. Laces 30 extend from side holes 32 of blinder 10 (see FIG. 3) and through holes 26 of ear guards 24 so that blinder 10 may be attached from its sides. Extension 34 loops around top band 22 to position blinder 10 over the eyes of the wearer so that eye pillows 12 are generally aligned with the eye sockets of the wearer.

Strap headgear arrangement 8 comprises strap headgear 20 and blinder attachment 10. Strap headgear 20 has a conventional design which includes connecting straps or portions 36, 38, 40, and 42 which are attached to two ear guards 44. Ear guards 44 have four holes 46 and are removably attached at their lower portions by chin strap 48. Laces 30 extend from side holes 32 of blinder 10 and through holes 46 of ear guards 44 so that blinder 10 may be attached from its sides. Extension 34 loops around top connecting strap 36 to position blinder 10 over the eyes of the wearer so that eye pillows 12 are generally aligned with the eye sockets of the wearer.

Figure 3:
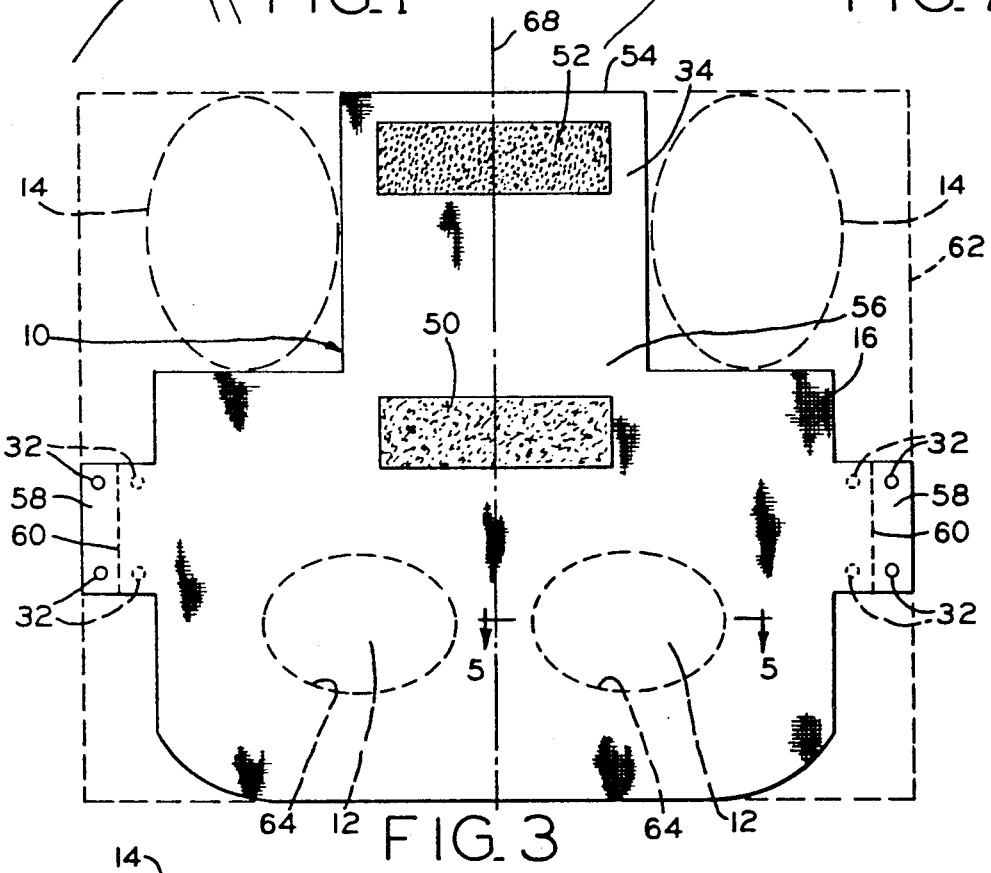
FIG. 3 is a top, plan view of the blinder attachment.

As shown in FIG. 3, blinder attachment 10 comprises body portion 16, extension 34, eye pillows 12, side holes 32, and matching securing or attaching strips 50 and 52. Body portion 16 is generally rectangular and shaped to extend from the forehead to the end of the nose of the wrestler wearing blinder 10, with eye pillows 12 located on body 16 for filling the wearer's eye sockets. Extension 34 is located at the top of body portion 16 and has end 54 farthest from body 16 and base 56 adjacent to body 16. Securing strip 52 is located adjacent to end 54 and securing strip 50 is located adjacent base 56. Extension 34 has a length which enables it to wrap over top band 22 or top connecting strap 42 and allow matching securing strips 50 and 52 to attach and form loop 57 securing blinder 10 to headgear 18 or 20. Holes 32 are formed in side arms 58 of body 16 and receive laces 30. Side arms 58 may be folded over at lines 60 and sewn to double the thickness of arms 58 or grommets (not shown) may be used to reinforce holes 32 so that laces 30 do not tear the material of body 16 at arms 58.

Blinder attachment 10 may be made from a single piece of material, for example rectangular section 62. To construct blinder 10, its outline is cut from section 62, and then the pads 14 may be cut from the remaining material. Preferably, arms 58 are folded over line 60 and sewn together before forming holes 32. A border of overlock stitching is sewn around the outer periphery of blinder 10 and eye pads 14 to help prevent fraying at the edges. Eye pillows 12 are then provided on the wearer's side of body 16, and securing strips 50 and 52 are sewn on the non-wearer's side of body 16. Finally, laces 30 may be extended through holes 32 so that blinder attachment 10 is ready for attachment to halo headgear 18 or strap headgear 20.

Eye pillows 12 may be separately constructed and attached to blinder body 16, or they may be formed by the connection of eye pad 14 to blinder body 16 at reduced periphery 64. Preferably, eye pads 14 are sewn on the wearer's side of body 16 along the outline of reduced periphery 64, which is a slightly smaller oval shape than the oval shape of eye pads 14. By attaching eye pads 14 to body 16 at reduced periphery 64, eye pillow 12 is defined and space exists for placing stuffing 66 in eye pillow 12. Stuffing 66 may include portions of section 62 which have not been used for blinder 10 or eye pads 14.

In the preferred embodiment, body 16 and eye pads 14 comprise terry cloth material. Alternatively, spandex, canvas, or other suitable material having the preferred characteristics of comfortability, absorbency, and durability. To provide an example of the present invention in a preferred form, the following description provides dimensions in terms of length from the center line 68 of section 62 and length from end 54 of extension 34. In the preferred embodiment, extension 34 is centered on line 68 and is about 4 inches wide (along end 54) and 3.75 inches tall (from end 54 to body 16). Body 16 is centered on line 68 and is about 9 inches wide and 5.625 inches tall, with the lower corners preferably being rounded. Securing strips 50 and 52 may be synthetic strips which adhere when pressed together, for example VELCRO TM . Velcro TM strips 50 and 52 are about 3 inches long and 1 inch wide, with both being centered on line 68, strip 50 about 4.25 inches below end 54 and strip 50 about 0.375 inches below end 54. Eye pads 14 initially have a generally elliptical shape with a major axis of about 3.5 inches and a minor axis of about 2.5 inches, which after attachment at reduced periphery 64 have a generally elliptical shape with a major axis of about 3 inches and a minor axis of about 2.25 inches. Eye pads 14 are sewn to body 16 at the outline of reduced periphery 64 which has generally elliptical shape with a major axis of about 2.5 inches and a minor axis of about 1.75 inches. Elliptical eye pads 14 are centered at points about 7 inches from end 54 and about 1.75 inches on each side of line 68. Arms 58 are about 1 inch wide and 1.625 inches tall, with the top of arms 58 laterally extending from body 16 about 5 inches vertically below end 54. Holes 32 have diameters of about 0.125 inches and have their centers located about 0.25 inches from body 16 and from the top and bottom edges of arm 58.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blinder attachment for use with wrestling headgear so that the eyes of the wearer of the headgear are generally blocked, said blinder attachment comprising:

a body portion adapted to cover the eyes, said body portion including an extension projecting from a base of said body portion to an end of said extension, said extension adapted to wrap around a portion of the headgear so that said extension end may be positioned adjacent to said base; and means for attaching said extension end and said base thereby forming a loop with said extension so that said blinder attachment may be secured to the headgear.

2. The blinder attachment of claim 1 wherein said body portion includes two eye pillows.

3. The blinder attachment of claim 2 wherein said eye pillows have a generally oval shape and a thickness adapted to occupy substantially all of the eye socket of the wearer.

4. The blinder attachment of claim 3 wherein said eye pillows include oval shaped eye pads attached to said body portion at a reduced periphery.

5. The blinder attachment of claim 1 wherein said attaching means includes matching securing strips, one of said securing strips located adjacent to said end and the other of said strips located adjacent to said base.

6. The blinder attachment of claim 1 wherein said body portion includes a plurality of holes, and said blinder attachment further comprises laces extending through said holes in said body portion.

7. The blinder attachment of claim 1 wherein said body portion is comprised of terry cloth material.

8. A wrestling blinder adapted to be attached to the head of a wrestler so that the eyes of the wrestler are generally blocked, said blinder comprising:

a headgear portion including a top portion, two ear guards, and means for securing said headgear to the head; and a blinder portion including a body portion adapted to cover the eyes, and means for securing said blinder to said headgear, said body portion including two eye pillows.

9. The blinder of claim 8 wherein said blinder portion includes a base and an extension having an end, said extension wrapping around said top portion of said headgear so that said extension end is positioned adjacent to said base, said securing means of said blinder portion attaching said extension end and said base thereby forming a loop over said top portion so that said blinder attachment is secured to said headgear.

10. The blinder of claim 9 wherein said attaching, means includes matching securing strips, one of said securing strips located adjacent to said extension end and the other of said strips located adjacent to said base.

11. The blinder of claim 8 wherein said body portion includes two eye pillows.

12. The blinder of claim 8 wherein said eye pillows have a generally oval shape and a thickness adapted to occupy substantially all of the eye socket of the wearer.

13. The blinder of claim 12 wherein said eye pillows include oval shaped eye pads attached to said body portion at a reduced periphery.

14. A wrestling blinder adapted to be attached to the head of a wrestler so that the eyes of the wrestler are generally blocked, said blinder comprising:

a headgear portion including a top portion, two ear guards, and means for securing said headgear to the head; and a blinder portion including a body portion adapted to cover the eyes, and means for securing said blinder to said headgear, said body portion including a plurality of holes, and said blinder attachment further comprising laces extending through said holes in said body portion and said headgear.

15. The blinder of claim 14 wherein said ear guards include holes for receiving said laces.

16. The blinder of claim 8 wherein said body portion is comprised of terry cloth material.

17. The blinder of claim 8 wherein said headgear has a halo arrangement.

18. The blinder of claim 8 wherein said headgear has a strap arrangement.

19. A wrestling blinder adapted to be attached to the head of a wrestler so that the eyes of the wrestler are generally blocked, said blinder comprising:

a headgear portion including a top portion, two ear guards each having a plurality of holes, and means for securing said headgear to the head; and a blinder portion including a body portion adapted to cover the eyes, said body portion including a base and an extension having an end, said extension wrapping around said top portion of said headgear so that said extension end may be positioned adjacent to said base, said blinder portion including means for attaching said extension end and said base thereby forming a loop around said top portion so that said blinder portion is secured to said headgear.

20. The blinder of claim 19 wherein said blinder body portion includes holes, said blinder further comprising laces extending through said blinder body holes and said ear guard holes.

* * * * *